US007510265B2

(12) United States Patent
Kang et al.

(10) Patent No.: US 7,510,265 B2
(45) Date of Patent: Mar. 31, 2009

(54) INK-JET IMAGE FORMING APPARATUS AND METHOD OF CLEANING PRINTBAR

(75) Inventors: Seung-wook Kang, Seoul (KR); Heon-soo Park, Seongnam-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 428 days.

(21) Appl. No.: 11/340,810

(22) Filed: Jan. 27, 2006

(65) Prior Publication Data

US 2006/0274110 A1 Dec. 7, 2006

(30) Foreign Application Priority Data

Jun. 2, 2005 (KR) ..... 10-2005-0047178

(51) Int. Cl.
*B41J 2/165* (2006.01)

(52) U.S. Cl. ..... 347/33; 347/32

(58) Field of Classification Search ..... 347/21, 347/25, 33, 32
See application file for complete search history.

(56) References Cited

U.S. PATENT DOCUMENTS 3,661,505 A * 5/1972 Frolich ..... 422/3
5,432,539 A * 7/1995 Anderson ..... 347/33
5,790,147 A 8/1998 Hensel
6,022,104 A * 2/2000 Lin et al. ..... 347/102
2002/0063748 A1 * 5/2002 Takahashi et al. ..... 347/33

FOREIGN PATENT DOCUMENTS

| | | | |
|---|---|---|---|
| JP | 4-77263 | 3/1992 | |
| JP | 4-141440 | 5/1992 | |
| JP | 4-282257 | 10/1992 | |
| JP | 5-8403 | 1/1993 | |
| JP | 2003-334962 | 11/2003 | |
| KR | 2003-45317 | 6/2003 | |
| KR | 2003-0045317 A * | 6/2003 | ..... 347/32 |
| KR | 2004-64086 | 7/2004 | |

OTHER PUBLICATIONS

Korea Office Action dated Jul. 28, 2006 issued in KR 2005-47178.

* cited by examiner

*Primary Examiner*—Julian D Huffman
*Assistant Examiner*—Jason S Uhlenhake
(74) *Attorney, Agent, or Firm*—Stanzione & Kim, LLP

(57) ABSTRACT

An ink-jet image forming apparatus includes an ink-jet head having a printbar provided with a plurality of nozzles to eject ink droplets, a steam sprayer to spray steam onto the printbar, and a wiper movable relative to the ink-jet head to wipe the printbar sprayed with the steam.

8 Claims, 5 Drawing Sheets

INK-JET IMAGE FORMING APPARATUS AND METHOD OF CLEANING PRINTBAR

CROSS-REFERENCE TO RELATED APPLICATIONS

This application claims priority from Korean Patent Application No. 10-2005-0047178, filed on Jun. 2, 2005, in the Korean Intellectual Property Office, the disclosure of which is incorporated herein in its entirety by reference.

BACKGROUND OF THE INVENTION

1. Field of the Invention

The present general inventive concept relates to an ink-jet image forming apparatus and a method of cleaning a printbar.

2. Description of the Related Art

In general, an ink-jet image forming apparatus forms a desired image by ejecting ink droplets onto a recording medium from a shuttle-type ink-jet head moving in a direction (a width direction of a recording medium) perpendicular to a conveying direction of the recording medium. The shuttle-type ink-jet head includes a printbar provided with a plurality of nozzles for ejecting the ink droplets. The ink droplets that are not ejected remain around the nozzles. After the printing operation is performed, if the printbar is exposed to the atmosphere, the ink droplets that remain around the nozzles may be solidified. In addition, dusts or fine particles contained in the atmosphere may adhere to the printbar. The solidification of the ink droplets or adhesion of the dusts alters an ejection direction of the droplets during subsequent printing operations, thereby deteriorating an image quality of a printed image.

Recently, instead of the shuttle-type ink-jet head, attempts to print at higher speeds use of an array ink-jet head that includes a printbar having a length in a main scanning direction corresponding to a width of a recording medium. In such an ink-jet image forming operation, the array ink-jet head is stationary, while only the recording medium is conveyed in a direction perpendicular to the main scanning direction. Hence, a drive mechanism of the ink-jet image forming apparatus is simple, and it is possible to achieve the higher printing speeds. According to the ink-jet image forming apparatus, the length of the printbar is about 210 mm to correspond to an A4 size of the recording medium, disregarding the printing margin of the width direction of the recording medium. Therefore, there is a need for an apparatus that effectively removes alien substances from the long printbar.

SUMMARY OF THE INVENTION

The present general inventive concept provides an ink-jet image forming apparatus and a cleaning method thereof, which effectively removes an alien substance from a printbar of an ink-jet head.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an ink-jet image forming apparatus comprising an ink-jet head having a printbar provided with a plurality of nozzles to eject ink droplets, a steam spraying unit to spray steam onto the printbar, and a wiper movable relative to the ink-jet head to wipe the printbar sprayed with the steam.

The steam spraying unit may include a steam generator to heat a cleaning solution to generate the steam, and a steam cap facing the printbar and movable relative to the ink-jet head, the steam cap having a nozzle to spray the steam supplied from the steam generator, and a discharge port to discharge an alien substance and a liquefied cleaning solution removed from the printbar. A clearance may be provided between the steam cap and the printbar. The nozzle of the steam cap may be located at a position higher than the discharge port. The wiper may be located on the steam cap.

The ink-jet image forming apparatus may further include a thermometer and a manometer to respectively detect a temperature and a pressure of the steam generator, and a controller to control a heater of the steam generator based on the detected temperature and pressure so that the steam generator does not overheat. The ink-jet image forming apparatus may further comprise a valve located between the steam generator and the nozzle of the steam cap, and the controller may open and close the valve.

The ink-jet head may be a shuttle-type ink-jet head moveable in a main scanning direction, or may be an array ink-jet head that ejects ink droplets onto a recording medium in a stationary position.

The foregoing and/or other aspects and utilities of the present general inventive concept may also be achieved by providing an ink-jet image forming apparatus comprising an ink-jet head having a printbar provided with a plurality of nozzles to eject ink droplets, the printbar having a length in a main scanning direction corresponding to a width of a recording medium, a steam generator to heat a cleaning solution to generate steam, a steam cap facing the printbar and movable relative to the ink-jet head, the steam cap having a nozzle to spray the steam supplied from the steam generator, and a wiper moveable in the main scanning direction to wipe the printbar sprayed with the steam.

A clearance may be provided between the steam cap and the printbar. The steam cap may have a discharge port to discharge an alien substance and a liquefied cleaning solution removed from the printbar, and the nozzle of the steam cap may be located at a position higher than the discharge port. The wiper may be located on the steam cap.

The foregoing and/or other aspects and utilities of the present general inventive concept may also be achieved by providing a method of cleaning a printbar of an ink-jet head, the method including spraying steam onto the printbar through a nozzle of a steam cap to wet the printbar and to lessen an adhesion of an alien substance to the printbar, and wiping the printbar with a wiper to remove the alien substance from the printbar.

The printbar may have a length of a main scanning direction corresponding to a width of a recording medium, and the steam cap and the wiper may be moveable in the main scanning direction.

The foregoing and/or other aspects and utilities of the present general inventive concept may also be achieved by providing a service station usable in an ink-jet image forming apparatus, the service station comprising at least one steam spraying unit and at least one wiping unit. The ink-jet image forming apparatus may comprise an ink-jet head comprising a printbar, and the service station. The service station may further comprise a steam cap, a controller, at least one of a heater and a discharging unit, and at least one of a thermometer and a manometer. The printbar may further comprise at least one nozzle plate comprising a plurality of nozzle arrays, and the ink-jet head may be a shuttle-type ink-jet head or an array-type ink-jet head.

The foregoing and/or other aspects and utilities of the present general inventive concept may also be achieved by providing an image forming apparatus comprising an ink head having a printbar provided with a plurality of nozzles, and a spraying unit to spray steam toward the ink head to remove a substance from the ink head.

The foregoing and/or other aspects and utilities of the present general inventive concept may also be achieved by providing an ink-jet image forming apparatus comprising an ink-jet head having a printbar provided with a plurality of nozzles to eject ink droplets, and a steam spraying unit to spray steam onto the printbar.

The foregoing and/or other aspects and utilities of the present general inventive concept may also be achieved by providing an ink-jet image forming apparatus comprising an ink-jet head having a printbar provided with a plurality of nozzles to eject ink droplets, the printbar having a length in a main scanning direction corresponding to a width of a recording medium, a steam generator to heat a cleaning solution to generate steam, and a steam cap facing the printbar and movable relative to the ink-jet head, the steam cap having a nozzle to spray the steam supplied from the steam generator.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which

DETAILED DESCRIPTION OF THE EMBODIMENTS

Figure 1:
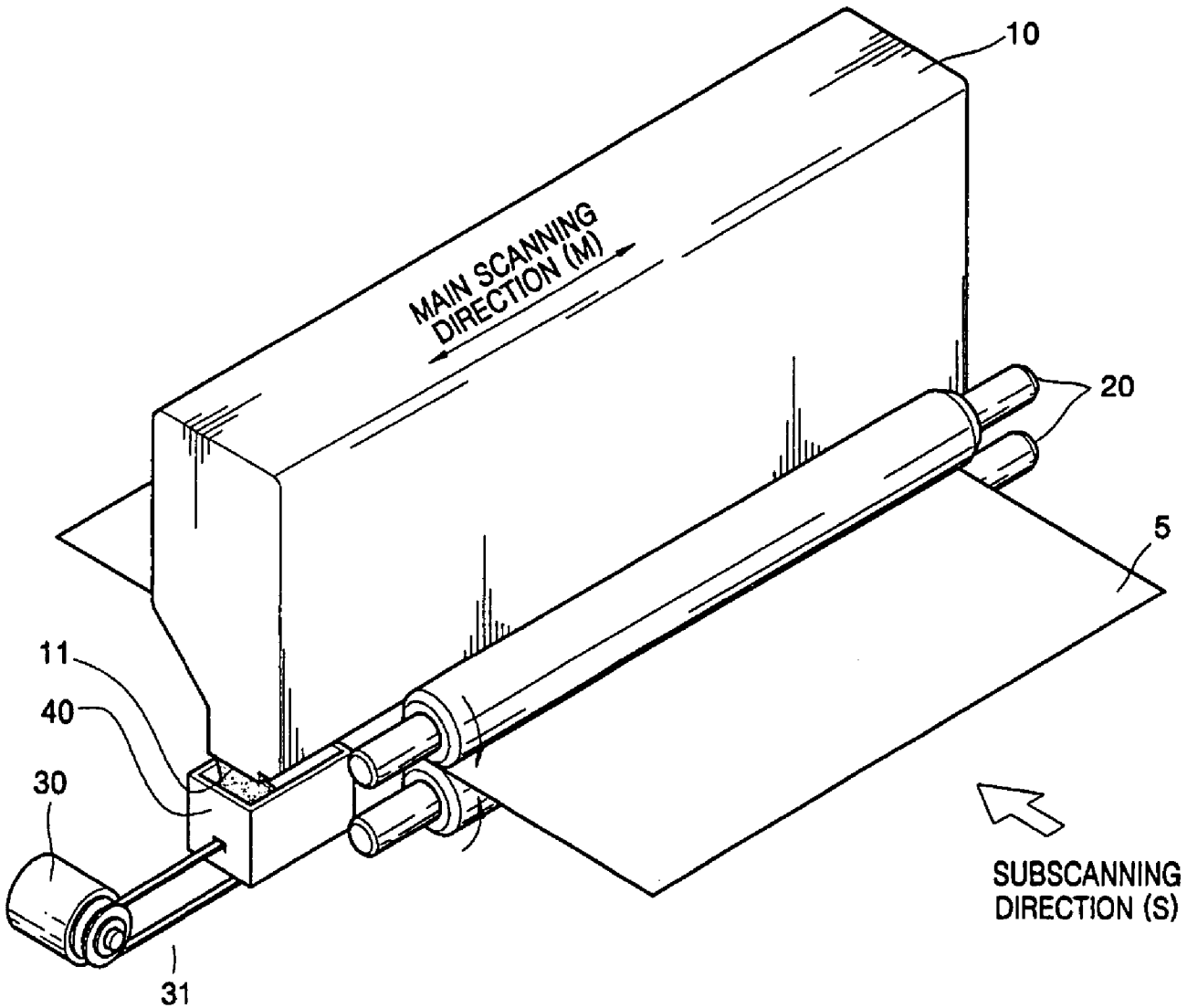
FIG. 1 is a perspective view illustrating an ink-jet image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a perspective view illustrating an ink-jet image forming apparatus according to an embodiment of the present general inventive concept. Referring to FIG. 1, a recording medium 5 is conveyed in a sub scanning direction S by a pair of rollers 20 rotating in contact with each other. An ink-jet head 10 is located above the recording medium 5. The ink-jet head 10 ejects ink droplets in a stationary position to print an image on the recording medium 5.

Figure 2:
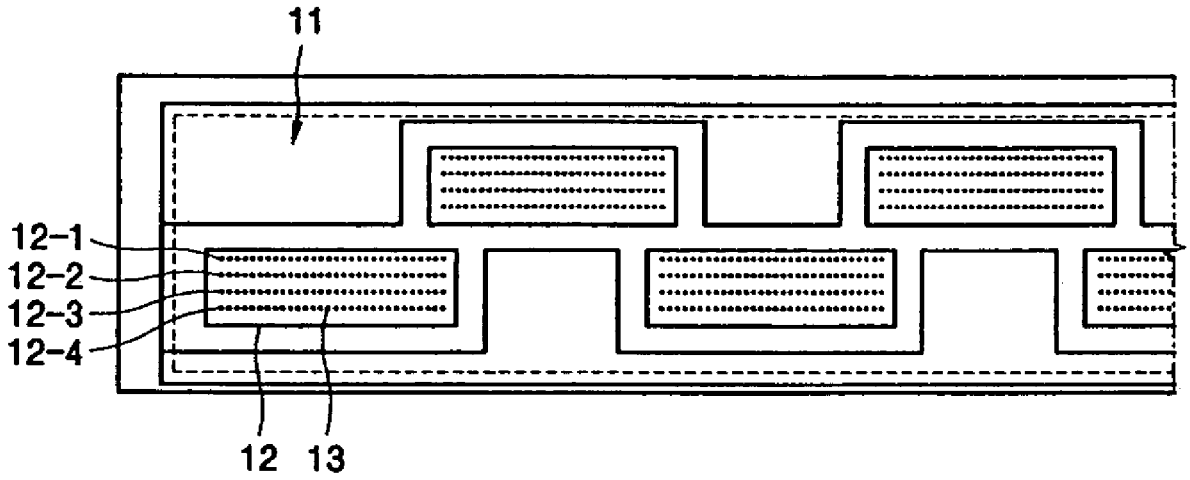
FIG. 2 is a view illustrating an embodiment of a printbar useable in the ink-jet image forming apparatus of FIG. 1.
Figure 3:
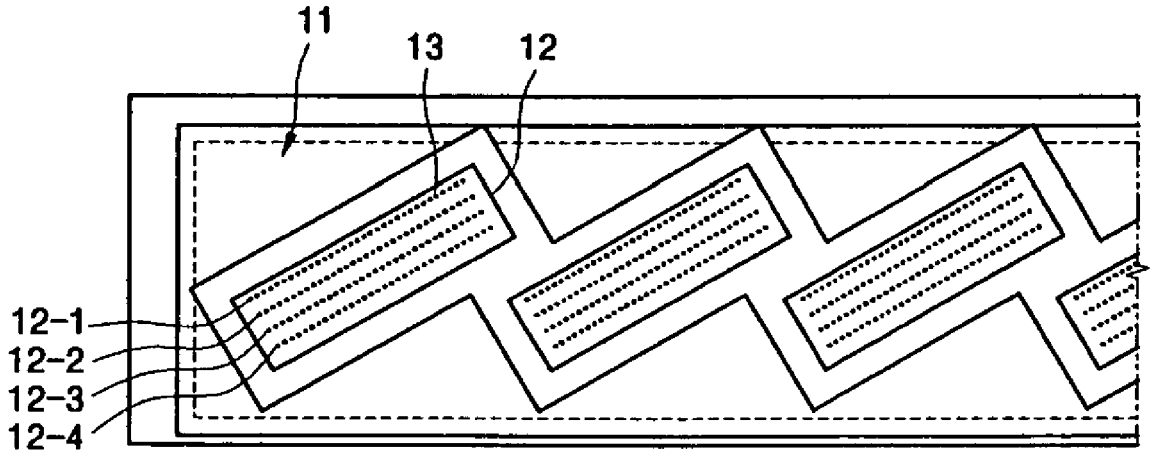
FIG. 3 is a view illustrating another embodiment of a printbar useable in the ink-jet image forming apparatus of FIG. 1.

The ink-jet head 10 of this embodiment may be an array ink-jet head including a printbar 11 having a length of a main scanning direction M corresponding to a width of the recording medium 5. FIGS. 2 and 3 are views illustrating embodiments of the printbar 11 useable in the ink-jet image forming apparatus of FIG. 1. Referring to FIGS. 1, 2, and 3, the printbar 11 includes a plurality of nozzle plates 12 arranged in the main scanning direction M. The each nozzle plate 12 is formed with a plurality of nozzles 13 to eject the ink droplets. The nozzle plate 12 may be provided with plural arrays of nozzles 12-1, 12-2, 12-3 and 12-4. The arrays of nozzles 12-1, 12-2, 12-3 and 12-4 may eject ink droplets of same color or different colors (for example, cyan, magenta, yellow, and black), respectively. FIGS. 2 and 3 illustrate embodiments of the printbar 11, and do not intend to limit a scope of the present general inventive concept.

Although not shown, the ink-jet head 10 includes a chamber communicated with each nozzle 13, and having a discharging unit to supply pressure to discharge ink (e.g., piezoelectric device, heater or the like) and a channel to supply the ink into the chamber. The chamber, the discharging unit and the channel are well known to those skilled in the art, and thus are not described in detail herein.

If the printbar 11 is exposed to the atmosphere, the ink droplets that remain around the nozzles 13 may solidify. In addition, dusts or fine particles contained in the atmosphere may adhere to the printbar 11. The solidification of the ink droplets or adhesion of the dusts alters an ejection direction of the ink droplets during subsequent printing operations, thereby deteriorating a printing quality. Also, the ink droplets are continuously vaporized and clog the nozzles 13. In particular, since the array ink-jet head 10 prints the image at the stationary position, if a part of the nozzle 13 is clogged, a white or missing line appears on the printed image. In order to prevent the above phenomenon, it is necessary to isolate the printbar 11 from the atmosphere by capping the printbar 11 when the image forming apparatus is not performing a printing operation.

At present, a surface of the printbar 11 is generally wiped with a wiper 50. In order to effectively clean the printbar 11 with the wiper, the printbar 11 is always maintained in a wet state. To this end, it is necessary to provide a capping apparatus (not shown) to cap the print bar 11 to isolate the printbar 11 from the atmosphere. However, even when the ink-jet image forming apparatus includes the capping apparatus, the capping apparatus must be correctly-positioned. If the capping apparatus is not correctly-positioned, the ink on the printbar 11 is vaporized and solidified, thereby increasing an adhering force of the alien substance (such as ink dregs and fine dusts) onto the printbar 11. Hence, it is difficult to wipe the printbar 11 with the wiper 50.

The ink-jet image forming apparatus according to the present embodiment sprays steam onto the printbar 11 to effectively remove the alien substance from the printbar 11. To this end, the ink-jet image forming apparatus according to the present embodiment includes a steam spraying unit.

Figure 4:
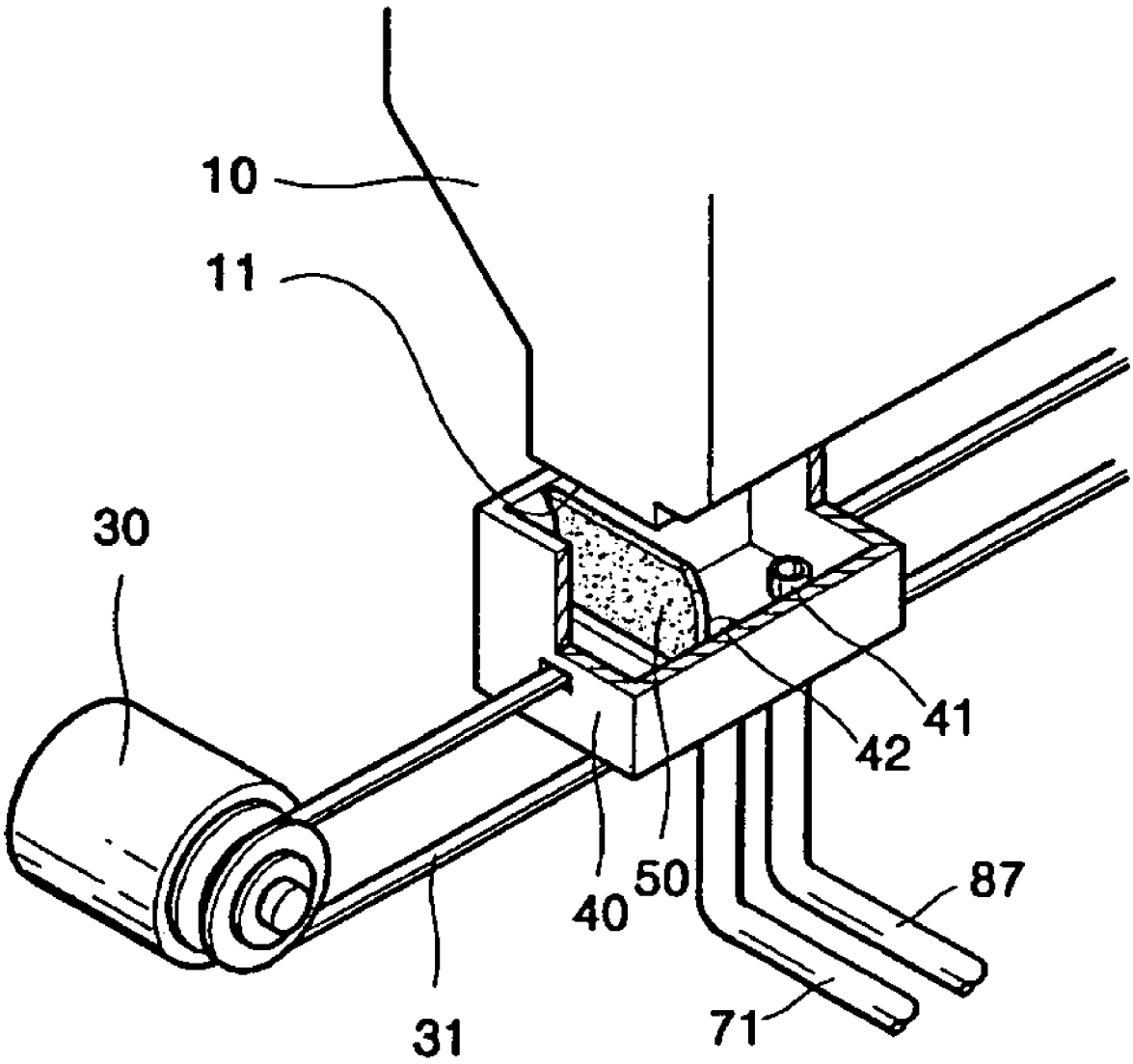
FIG. 4 is a perspective view illustrating an embodiment of a steam spraying unit useable in the ink-jet image forming apparatus of FIG. 1.
Figure 5:
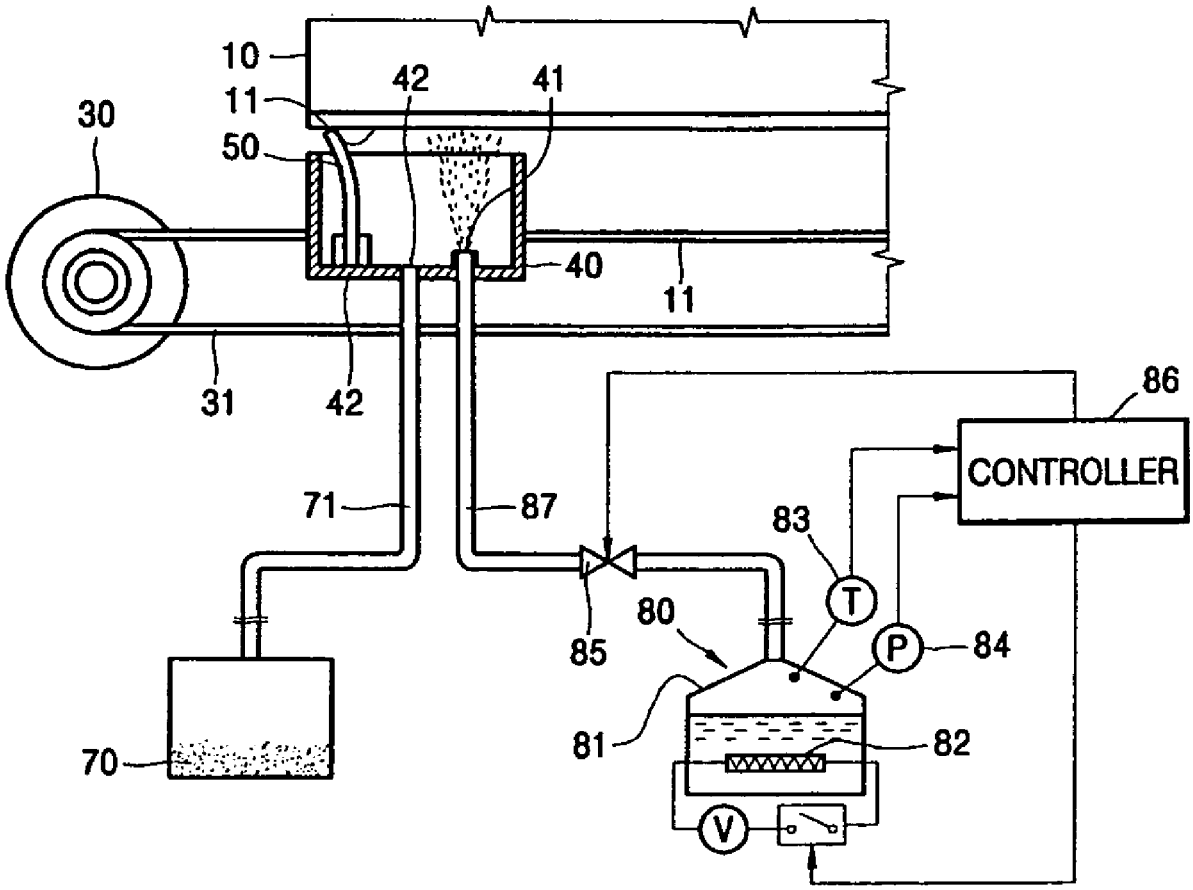
FIG. 5 is a cross-sectional view illustrating the steam spraying unit of FIG. 4.

Referring to FIGS. 1, 4, and 5, the steam spraying unit includes a steam generator 80 and a steam cap 40. A wiper 50 is located on the steam cap 40. The steam cap 40 is connected to a belt 31 movable in the main scanning direction M (see FIG. 1) by a drive motor 30. The wiper 50 employs an elastic rubber blade as shown in FIG. 5. Although not shown, a cleaning roller rotating in contact with the printbar 11 may be employed. A cleaning solution (e.g., water) contained in a cleaning solution reservoir 81 is heated by a heater 82 to generate steam. The steam flows to a nozzle 41 of the steam cap 40 through a steam tube 87. Temperature and pressure in the cleaning solution reservoir 81 are measured by a thermometer 83 and a manometer 84, respectively. The measured temperature and pressure are input into a controller 86. The controller 86 controls the heater 81 so that the temperature of the cleaning solution and the pressure in the cleaning solution reservoir 81 are not excessively high. A discharge port 42 communicates with a waste reservoir 70 through a waste tube 71.

A cleaning process will now be described with reference to the above construction. When the drive motor 30 rotates, the steam cap 40 moves in a longitudinal direction (main scanning direction M) of the printbar 11. The controller 86 opens a valve 85. The steam is sprayed onto the printbar 11 through the nozzle 42. The steam is sprayed in front of the wiper 50. The alien substance adhered to the surface of the printbar 11 is wet by the hot pressurized steam to lessen the adhering force of the alien substance. The wet alien substance is removed from the printbar 11 by the moving wiper 50. In particular, the steam directly contacting the surface of the relatively cold printbar 11 is liquefied, and the alien substance is wet by the liquefied steam. Through the movement of the wiper 50, the wiper 50 removes the alien substance together with the liquefied steam from the printbar 11. The alien substance and the liquefied cleaning solution removed from the printbar 11 are discharged through the discharge port 42 and through the waste tube 71, and are stored in the waste reservoir 70.

Thus, with the ink-jet image forming apparatus according to one embodiment of the present general inventive concept, the steam is sprayed onto the printbar 11 to lessen the adhering force of the alien substance, so that the alien substance may be effectively removed. Hence, in a situation where the capping apparatus is not provided or the capping apparatus is not correctly-positioned, the alien substance may still be easily removed from the printbar 11. In addition, the adhering force of the alien substance may be lessened by even a small quantity of the steam, since the hot pressurized steam is sprayed. Therefore, there is no possibility that the cleaning solution is leaked to pollute the image forming apparatus.

If the steam cap 40 is immoveable, the steam cap 40 has a size to cover the whole printbar 11. A plurality of nozzles 41 are needed to spray the steam over the entire surface of the printbar 11. Since an amount of steam sprayed at once is very large, a leaking amount of the steam is increased, and thus a capacity of the steam generator 80 has to be correspondingly increased. Hence, a conventional apparatus for cleaning the printbar 11 is very large and complicated. This apparatus may be easily applied to a machine (cleaning machine) that exclusively functions to clean the ink-jet head 10 only, but is applied to the image forming apparatus with difficulty. According to an embodiment of the present general inventive concept, since the steam cap 40 and the wiper 50 move in the main scanning direction M, the apparatus of cleaning the printbar 11 of the array ink-jet head 10 becomes compact so that it may be more easily applied to the ink-jet image forming apparatus. Also, since very small quantity of the steam is continuously sprayed, the leakage of the steam can be minimized.

A clearance is provided between the steam cap 40 and the printbar 11. If the steam cap 40 is in contact with the printbar 11 when the steam cap 40 moves, negative pressure is generated in the steam cap 40 and the ink from the nozzles 13 leaks. Thus, the clearance avoids this leaking problem. However, the clearance is minimized so as to reduce an amount of the steam leaked through the clearance.

In order to prevent the alien substance and the cleaning solution removed from the printbar 11 from flowing into the nozzle 41, the nozzle 41 is located at a position higher than the discharge port 42.

Although not shown, a separate cap having the wiper 50 and the discharge port 42 may be provided, but the discharge port 42 and the wiper 50 are located on the steam cap 40 so as to minimize the leakage of the steam, as shown in FIGS. 4 and 5.

Figure 6:
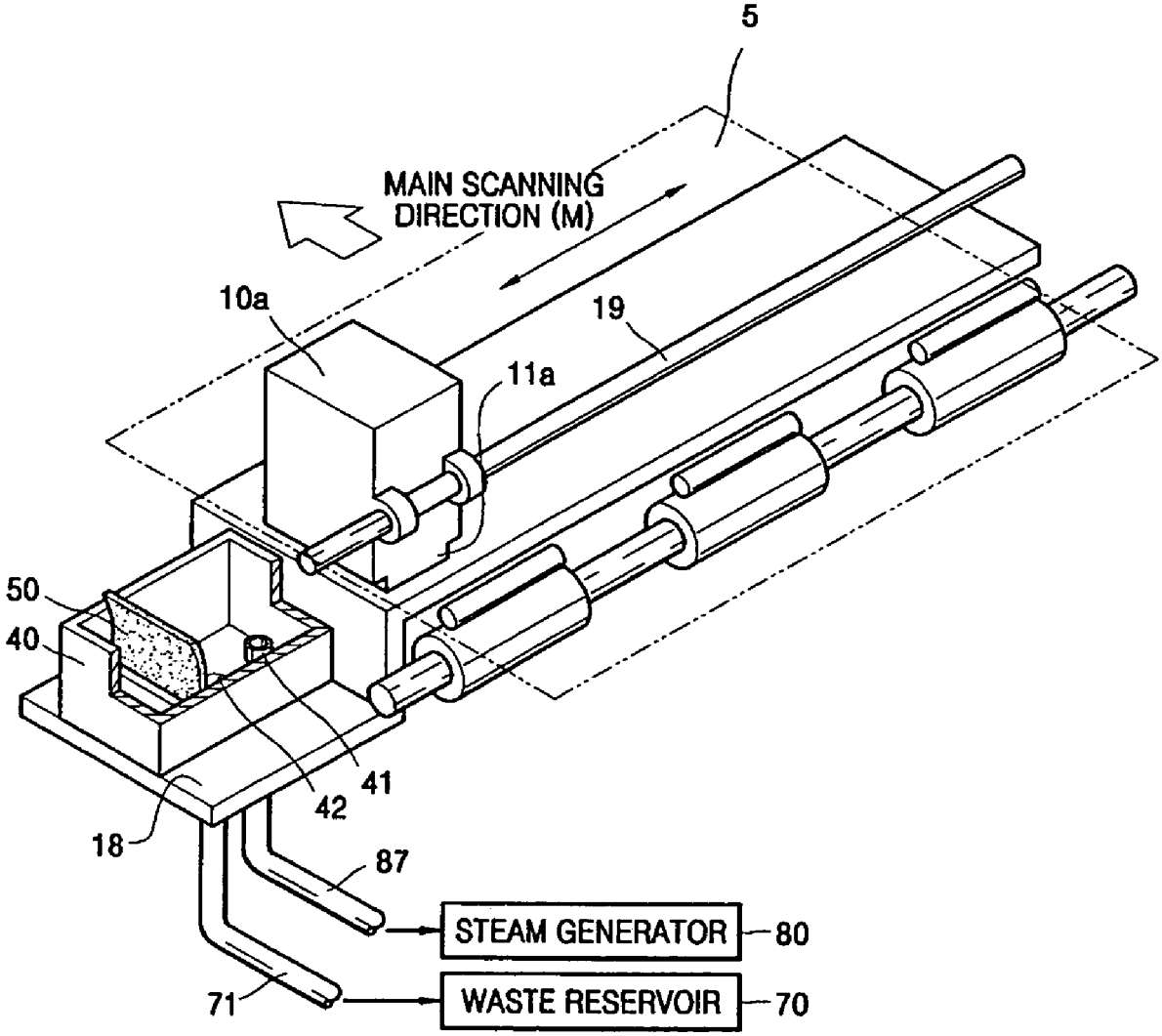
FIG. 6 a perspective view illustrating an ink-jet image forming apparatus according to another embodiment of the present general inventive concept.

The method of cleaning the printbar 11 by spraying the steam may be applied to an ink-jet image forming apparatus having a shuttle-type ink-jet head 10*a*, as shown in FIG. 6, as well as the array ink-jet head 10. Referring to FIG. 6, the ink-jet head 10*a* moves in the main scanning direction M along a shaft 19 to eject the ink droplets onto the recording medium 5 (conveyed in the sub scanning direction S) to print the image. A service station 18 is provided with the steam cap 40 and the wiper 50, as described above with reference to FIGS. 4 and 5. In general, the steam cap 40 is rigidly fixed to the service station 18, and the ink-jet head 10*a* moves in the main scanning direction M, thereby wiping the printbar 11*a* with the wiper 30. Alternatively, when the ink-jet head 10*a* arrives at the service station 18, the ink-jet head stops in a given position, and the steam cap 40 moves in the main scanning direction M or sub scanning direction S, thereby wiping the printbar 11, which does not limit the scope of the present general inventive concept. With the above construction, the same effect as that described in FIGS. 1 through 5 can be obtained.

Air can be used as the steam according to one embodiment of the present general inventive concept. The air can be contained in a reservoir and ejected toward the printbar 11. The air may include vapor or liquid particles corresponding to a cleaning solution. The air may be heated and/or pressurized.

With the above description, according to the ink-jet image forming apparatus and the method of cleaning the printbar of the ink-jet head of the present general inventive concept, the printbar is wet to lessen the adhering force of the alien substance, and then the alien substance is wiped with the wiper. Hence, the alien substance may be effectively removed. In addition, due to the use of the hot pressurized steam, the adhering force of the alien substance can be sufficiently lessened with a small amount of cleaning solution, thereby minimizing the amount of the cleaning solution used.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An ink-jet image forming apparatus comprising:

an ink-jet head having a printbar provided with a plurality of nozzles to eject ink droplets;

a steam spraying unit to spray steam onto the printbar; and a wiper movable relative to the ink-jet head to wipe the printbar sprayed with the steam, wherein the steam spraying unit comprises:

a steam generator to heat a cleaning solution to generate the steam; and a steam cap facing the printbar and movable relative to the ink-jet head, the steam cap having a nozzle to spray the steam supplied from the steam generator, and a discharge port to discharge an alien substance and a liquefied cleaning solution removed from the printbar, and wherein the nozzle of the steam cap is located at a position higher than the discharge port.

2. An ink-jet head having a printbar provided with a plurality of nozzles to eject ink droplets comprising:

a steam spraying unit to spray steam onto the printbar; arid a wiper movable relative to the ink-jet head to wipe the printbar sprayed with the steam, wherein the steam spraying unit comprises:

a steam generator to heat a cleaning solution to generate the steam; and a steam cap facing the printbar and movable relative to the ink-jet head, the steam cap having a nozzle to spray the steam supplied from the steam generator, and a discharge port to discharge an alien substance and a liquefied cleaning solution removed from the printbar, and wherein the ink-jet head comprises an array ink-jet head to eject ink droplets onto a recording medium in a stationary position, and the wiper and the steam cap moveable in a main scanning direction.

3. An ink-jet image forming apparatus comprising:

an ink-jet head having a printbar provided with a plurality of nozzles to eject ink droplets, the printbar having a length in a main scanning direction corresponding to a width of a recording medium;

a steam generator to heat a cleaning solution to generate steam;

a steam cap facing the printbar and movable relative to the ink-jet head, the steam cap having a nozzle to spray the steam supplied from the steam generator, wherein the steam cap has a discharge port to discharge an alien substance and a liquefied cleaning solution removed from the printbar, and the nozzle of the steam cap is located at a position higher than the discharge port.

4. The ink-jet image forming apparatus according to claim 3, wherein the wiper is located on the steam cap.

5. The ink-jet image forming apparatus according to claim 4, further comprising:

a thermometer and a manometer to detect a temperature and pressure of the steam generator; and a controller to control a heater of the steam generator based on the detected temperature and pressure so that the steam generator does not overheat.

6. The ink-jet image forming apparatus according to claim 5, further comprising:

a valve located between the steam generator and the nozzle of the steam cap, wherein the controller opens and closes the valve.

7. A method of cleaning a printbar of an ink-jet head, the method comprising:

spraying steam onto the printbar through a nozzle of a steam cap to wet the printbar and to lessen an adhesion of an alien substance to the printbar; and wiping the printbar with a wiper to remove the alien substance from the print bar, wherein the printbar has a length in a main scanning direction corresponding to a width of a recording medium, and the steam cap and the wiper are moveable in the main scanning direction.

8. An ink-jet image forming apparatus comprising:

an ink-jet head having a printbar provided with a plurality of nozzles to eject ink droplets, the printbar having a length in a main scanning direction corresponding to a width of a recording medium;

a steam generator to heat a cleaning solution to generate steam;

a steam cap facing the printbar and movable relative to the ink-jet head, the steam cap having a nozzle to spray the steam supplied from the steam generator and a discharge port to discharge an alien substance and a liquefied cleaning solution removed from the printbar; and a wiper movable in the main scanning direction to wipe the printbar sprayed with the steam, wherein the wiper, the nozzle to spray the steam, and the discharge port are provided inside the steam cap.

* * * * *